US006572286B2

(12) United States Patent
Earle et al.

(10) Patent No.: US 6,572,286 B2
(45) Date of Patent: Jun. 3, 2003

(54) METHOD AND SYSTEM FOR PHOTOGRAPHIC PROCESSING

(75) Inventors: Anthony Earle, Middx. (GB); Leslie Wells, London (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/114,687

(22) Filed: Apr. 2, 2002

(65) Prior Publication Data

US 2002/0176715 A1 Nov. 28, 2002

(30) Foreign Application Priority Data

Apr. 4, 2001 (GB) ..... 0108388

(51) Int. Cl.[7] ..... G03D 3/08; G03D 7/00

(52) U.S. Cl. ..... 396/612; 396/617; 396/620; 396/625; 396/639; 134/64 P

(58) Field of Search ..... 396/612, 615, 396/617, 620, 625, 639, 579; 226/108, 118.2, 119, 189; 242/364.2, 364.3; 134/64 P, 64 R, 122 R, 122 P

(56) References Cited

U.S. PATENT DOCUMENTS

| | | | | |
|---|---|---|---|---|
| 3,743,195 A | | 7/1973 | Bagdasarian | 242/364.2 |
| 3,827,646 A | | 8/1974 | Nielsen | 242/364.3 |
| 4,215,827 A | | 8/1980 | Roberts et al. | 242/364.3 |
| 4,344,073 A | * | 8/1982 | Rawlings | 396/620 |
| 4,967,222 A | * | 10/1990 | Nitsch | 226/108 |
| 5,432,580 A | * | 7/1995 | Tokuda | 355/27 |
| 5,493,360 A | * | 2/1996 | Pummell et al. | 396/616 |
| 5,568,822 A | * | 10/1996 | Michelson | 134/122 P |
| 5,585,879 A | * | 12/1996 | Tahara et al. | 355/40 |
| 6,020,948 A | * | 2/2000 | Tumidei | 396/625 |
| 6,082,908 A | | 7/2000 | Tumidei | 396/615 |

FOREIGN PATENT DOCUMENTS

| | | |
|---|---|---|
| EP | 0 798 596 A | 10/1997 |
| EP | 0 810 473 A | 12/1997 |

* cited by examiner

*Primary Examiner*—Della Rutledge
(74) *Attorney, Agent, or Firm*—Milton S. Sales

(57) ABSTRACT

A photographic processing system has a first processing stage to process photographic material. A second processing stage is also provided to further process the photographic material. A storage device is provided between the first processing stage and the second processing stage to receive and store photographic material output from the first processing stage prior to output to the second processing stage. This enables the photographic material to be output from the first processing stage at a different rate than that at which it is input to the second processing stage. Accordingly, the first processing stage can be vacated for use by subsequent photographic material before processing in the second processing stage is complete.

16 Claims, 3 Drawing Sheets

METHOD AND SYSTEM FOR PHOTOGRAPHIC PROCESSING

FIELD OF THE INVENTION

The present invention relates to a method and system for photographic processing. The invention is particularly suitable for use in single chamber processing systems such as, for example, the system disclosed in U.S. patent application Ser. No. 09/920,495 in the name of Twist et al.

BACKGROUND OF THE INVENTION

In conventional methods for processing photographic material, such as film, a number of distinct stages are involved such as, for example, developing, fixing/bleaching and washing stages. In a multi-chamber processing system, the film passes sequentially through each of these stages to produce the negatives, which are used to prepare developed photographs or scanned images. In a single-chamber system, all of the stages take place sequentially in a common chamber.

After the washing stage the film is usually dried before, as a final step of the processing, it is scanned or used together with photographic paper to produce an end product. The rate at which film can be processed is determined by the rate at which access to the chemical processing chamber (or chambers) of the processing system can be achieved. In a batch type process the time taken to remove film from the chemical processing chamber determines the overall utilisation of the system. Where the "rate determining step" for the process is external to the processing chamber, such as a low end type scanner, or slow dryer, it is only once the film has passed these stages that the processing chamber may become available to accept subsequent films.

For example, if scanning takes 20 seconds per frame (exposure) of the film then for a 40-exposure film the scanning stage alone takes 800 seconds. It is only once a film has substantially passed through the scanning stage that the next film to be processed can be provided to the processing chamber (or chambers) of the processing system. This problem is particularly noticeable in batch processing in a single chamber processor.

SUMMARY OF THE INVENTION

According to a first aspect of the present invention, a photographic processing system, includes: a first processing stage to process photographic material; and a second processing stage to further process the photographic material. A storage device provided between the first processing stage and the second processing stage receives and stores photographic material output from the first processing stage prior to output to the second processing stage. Thereby, the photographic material can be output from the first processing stage at a different rate than that at which it is input to the second processing stage.

Preferably, the first processing stage comprises one or more of developing, fixing, bleaching, combined fixing/bleaching and washing. The photographic material may be film, in which case the second processing stage may comprise scanning the developed film.

Preferably, the storage facility comprises a wet slack box having one or more path defining means such as rollers to define a storage path for photographic material that is output from the processing stage prior to entry into the scanning stage. Any other suitable sort of device may be used to define a path for the photographic material in the storage device such as, for example, an air knife. Preferably, the path defining means are moveable with respect to the webbing (and each other when there is more than one) to vary the length of the storage path.

In one preferred example of the present invention, the storage device also performs a drying function. In an alternative example, the storage device may be used as a final wash stage.

According to a second aspect of the present invention, a method of processing photographic material includes the steps of: processing the photographic material in a first processing stage; and storing the processed photographic material output from the first processing stage in a storage device. The storage device receives and stores a variable amount of the processed photographic material. The stored photographic material is provided to a second processing stage after a predetermined time interval.

According to a third aspect of the present invention, a photographic processing system includes: a processing stage to process photographic material and a drying stage to dry the photographic material after it has been processed by said processing stage. A storage device between the processing stage and the drying stage receives and stores the photographic material output from the processing stage to enable the material to be output from the processing stage at a different rate than that at which it is input to the drying stage, wherein heat from the processing system is provided to the storage device to at least partly dry the photographic material therein. A detector detects a parameter of the photographic material in the storage device and controls the drying stage in dependence thereon. Preferably, the heat provided from the processing system is exhaust heat from the drying stage.

ADVANTAGEOUS EFFECT OF THE INVENTION

The present invention provides a system in which the photographic material is able to exit the processing stage of the system at a different rate from that at which it enters the scanning stages. This effectively separates the scanning stage from the processing stage and enables the processing chamber(s) to be emptied before the scanning of the previous film. If the processing chamber is emptied, processing of the next film in sequence can start earlier than would otherwise have been possible thereby reducing the overall cycle time taken to process the films. This is particularly relevant to a single chamber batch processing system.

The use of rollers in a wet slack box provide a mechanically simple and robust system which enable photographic material to be stored safely prior to entering the scanner of the photographic system. In addition, where the rollers are moveable relative to each other the path length of photographic material stored in the slack box is variable enabling the amount of material stored to be controlled as desired in any particular situation.

By providing drying function to the storage device, the drying time of the material in the scanner can be greatly reduced. This means that the path length can be reduced of the material, which enables the overall system footprint to be correspondingly reduced.

When the storage device is used as a final wash stage it is possible to achieve faster access to the processing chamber.

In the third aspect of the present invention, a detector is provided to detect a parameter of the film stored in the storage device and provide a corresponding signal to the dryer. This parameter may be, for example, the humidity of the air in the storage device, which is related to the level of moisture contained in the stored film. Once this is known, the temperature in the dryer or the speed of passage of film through the dryer can be changed accordingly to improve the dryer efficiency.

BRIEF DESCRIPTION OF THE DRAWINGS

Examples of the present invention will now be described in detail with reference to the accompanying drawings, in which.

DETAILED DESCRIPTION OF THE INVENTION

Figure 1:
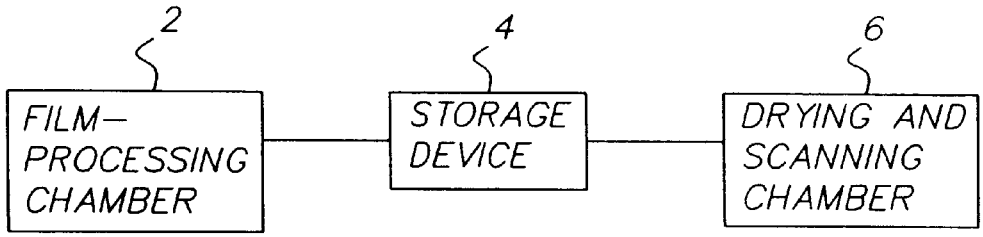
FIG. 1 shows a schematic block diagram of an example of a photographic processing system according to the present invention.

FIG. 1 shows a schematic block diagram of an example of a photographic processing system according to the present invention. The system will be described with reference to a film processing system although it relates equally to other photographic material such as silver halide photographic paper. The system has one or more chemical processing chambers 2 to receive and process photographic material such as film. In a conventional photographic processing system such as a mini-lab, separate chambers are provided for each of developing, fixing/bleaching and washing. In the single chamber processor described in U.S. patent application Ser. No. 09/920,495 all the steps of the processing are performed sequentially in a common chamber. The following description is written with reference to a single chamber processor as described in U.S. patent application Ser. No. 09/920,495 although the invention also applies to conventional photographic processing systems.

Initially, the film is provided to the film-processing chamber 2 of the processor. The necessary steps in chemical processing (developing, fixing/bleaching and washing) are carried out sequentially on the film as in conventional photographic processing. After the film exits the chemical processing chamber it proceeds to the drying and scanning chamber 6 and if necessary can be stored in the storage device 4. As will be explained below, the storage device 4 enables the film to be removed completely from the processing chamber 2 as soon as the processing is complete, thereby enabling the processing chamber to receive a second film to be processed without delay.

Figure 2A:
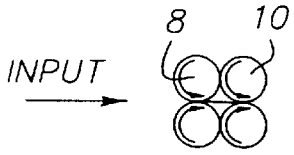
FIG. 2 shows a first example of a storage device suitable for use in the processing system of FIG. 1.
Figure 2B:
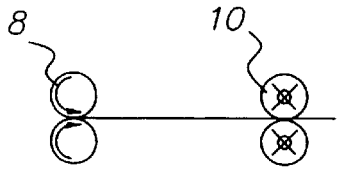
Figure 3B:
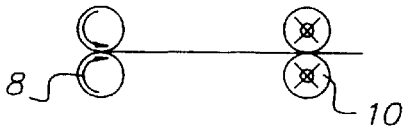
Figure 2C:
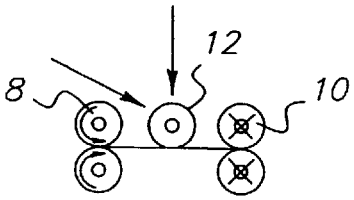
Figure 3C:
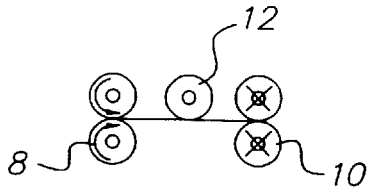
Figure 2D:
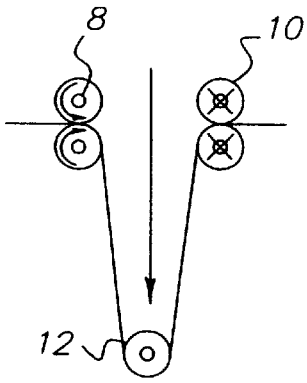
Figure 3D:
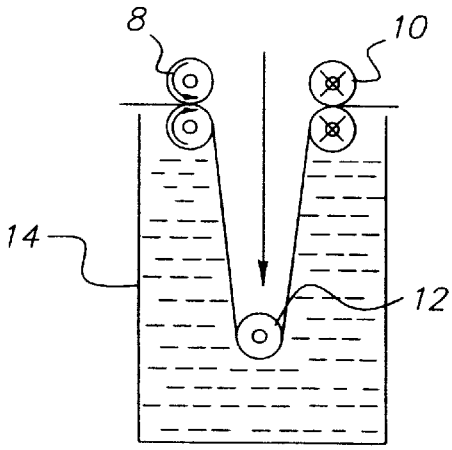
Figure 5A:
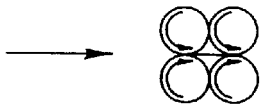
FIG. 5 shows an example of a storage device suitable for use in the processing system of FIG. 4.
Figure 5C:
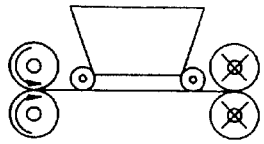
Figure 5B:
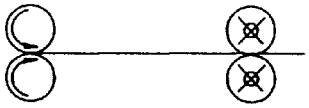
Figure 5D:
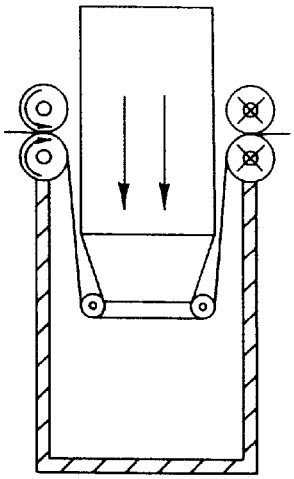

FIGS. 2*a* to 2*d* show a first example of a storage device suitable for use in the processing system of FIG. 1, in various stages of operation. The storage device has first and second roller pairs 8 and 10 arranged to receive the photographic material (film) after it has been processed in the chamber 2. As the film exits from the chamber 2, the rollers 8 and 10 are moved apart from each other as shown in FIG. 2*b*. After this, a third roller 12 shown in FIG. 2*c* is brought to bear on the film between the rollers 8 and 10 thereby increasing the path length between them. FIG. 2*d* shows roller 12 in its fully depressed condition at which point the path length of the film between rollers 8 and 10 is at a maximum.

In the case of a single chamber processor, the film will be fully fixed and washed once it exits from the processing chamber. There is therefore no need for the storage device 4 to be light-tight. However, if the device is to be used to store film that has not yet been fixed, a light-tight arrangement will be required.

Although the example shown in FIGS. 2*a* to 2*d* has a single pair of rollers 8 and 10 and a single roller 12 used to control the path length of the film, it will be appreciated that rollers 8 and 10 may be replaced by an array of spaced rollers and that roller 12 could be replaced by a moveable array of correspondingly spaced rollers. Thus, when the arrays are brought to bear on each other the change in path length will be much greater.

Figure 6:
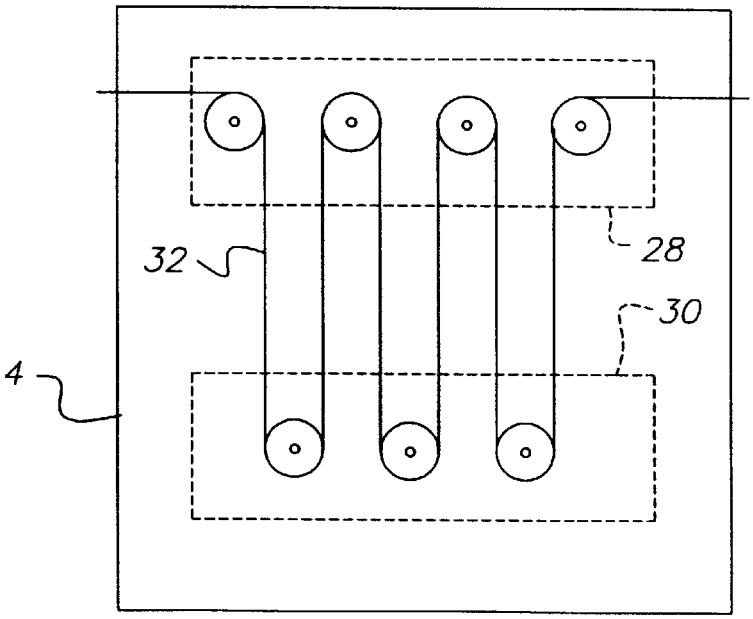
FIG. 6 shows an example of an arrangement of rollers suitable for use in a storage device for use in the processing system according to the present invention.

FIG. 6 shows an example of a suitable arrangement of rollers that could be used. Of course it is clear that what is essential is that the two arrays of rollers must be moveable relative to each other. Any other suitable device may be used to control the path length of the film in the storage device 4. For example, one or more air knives may be used instead of rollers.

FIG. 3 shows a second example of a storage device suitable for use in the processing system of FIG. 1. In this case, the principle of operation of the storage device is the same as that described above with reference to FIGS. 2*a* to 2*d*. However, in this case the storage device also operates as a wash stage so that one less processing step needs to take place in the main processing chamber 2 (from FIG. 1 above). A chamber 14 is therefore provided to hold a wash solution which washes the film as roller 12 is moved in a downward direction, away from rollers 8 and 10.

Tables 1 and 2 below show timing plans respectively for a processor as described in U.S. patent application Ser. No. 09/920,495 and a photographic processing system according to the present invention.

TABLE 1

| Time (s) | Film 1 | Film 2 | Film 3 |
|---|---|---|---|
| 0 | Into processor | | |
| 300 | Out of processor and into scanner/dryer | | |
| 1100 | Scanning complete | Into processor | |
| 1400 | | Out of processor and into scanner/dryer | |
| 2200 | | Scanning complete | Into processor |
| 2500 | | | Out of processor and into scanner/dryer |
| 3300 | | | Scanning complete |

TABLE 2

| Time (s) | Film 1 | Film 2 | Film 3 |
|---|---|---|---|
| 0 | Into processor | | |
| 300 | Out of processor and into scanner/ | Into processor | |

TABLE 2-continued

| Time (s) | Film 1 | Film 2 | Film 3 |
|---|---|---|---|
| | dryer (via storage device) | | |
| 600 | | Processing complete - into storage device | Into processor |
| 900 | | | Processing complete - into storage device |
| 1100 | Scanning complete | Out of storage device and into scanner/dryer | |
| 1900 | | Scanning complete | Out of storage device and into scanner/dryer |
| 2700 | | | Scanning complete |

Referring to Table 1, for the sake of example, it is assumed that the time taken to process each of the films is 300 seconds(s) and the time taken to dry and scan each of the films is 800 s. When T=0 s, the first film enters the processing chamber. At T=300 s the processing is complete and the first film can proceed to the drying and scanning stage. This takes 800 s and so at T=1100 s the first film has been completely scanned and dried. It is not until substantially all of the 800 s has elapsed that the final frame of the first film exits from the processing chamber such that the processing chamber is able to receive the second film. However, once this has happened, the process starts again and so a further 1100 s is required to process, dry and scan the second film (and the third film as well). The total time taken to process, dry and scan the three films is therefore approximately 3300 s.

Table 2 shows the steps in processing three films identical to the ones used in Table 1 above, using a processing system according to the present invention. Again, for the sake of example, it is assumed that the time taken to process each of the films is 300 seconds(s) and the time taken to dry and scan each film is 800 s. At T=0 s, the first film enters the processor. At T=300 s, the processing is complete and the first film can be removed from the processing chamber to the storage device from where it is fed to the drying and scanning stage. Since, at T=300 s the film can be completely removed from the processing chamber and stored in the storage device, the second film can be fed into the processing chamber without delay. At T=600 s the processing of the second film will be complete but the scanning of the first film will not yet have finished. The second film is therefore fed into the storage device where it is stored whilst the scanning of the first film is finished.

The processing chamber is therefore empty again and can now receive the third and final film in the batch. At T=900 s the processing of the third film is completed and it can now be transferred for storage to the storage device 4. Once the scanning of the first film is complete as T=1100 s, the second film can enter the scanner. Scanning and drying of the second film will take the whole 800 s and so at T=1900 s the third film can enter the scanner and dryer from the storage device 4. Scanning and drying of the third film will also take the whole 800 s and so at T=2700 s the processing and scanning of the batch of three films is complete. Thus in comparison to the processor used in the example described with reference to Table 1, a time saving of approximately 600 s (18%) has been achieved. This is clearly a considerable improvement. Once the storage device is full to capacity, film will not be able to leave the processing chamber and enter the storage device until a corresponding amount of film has passed from the storage device to the scanning stage.

Figure 4:
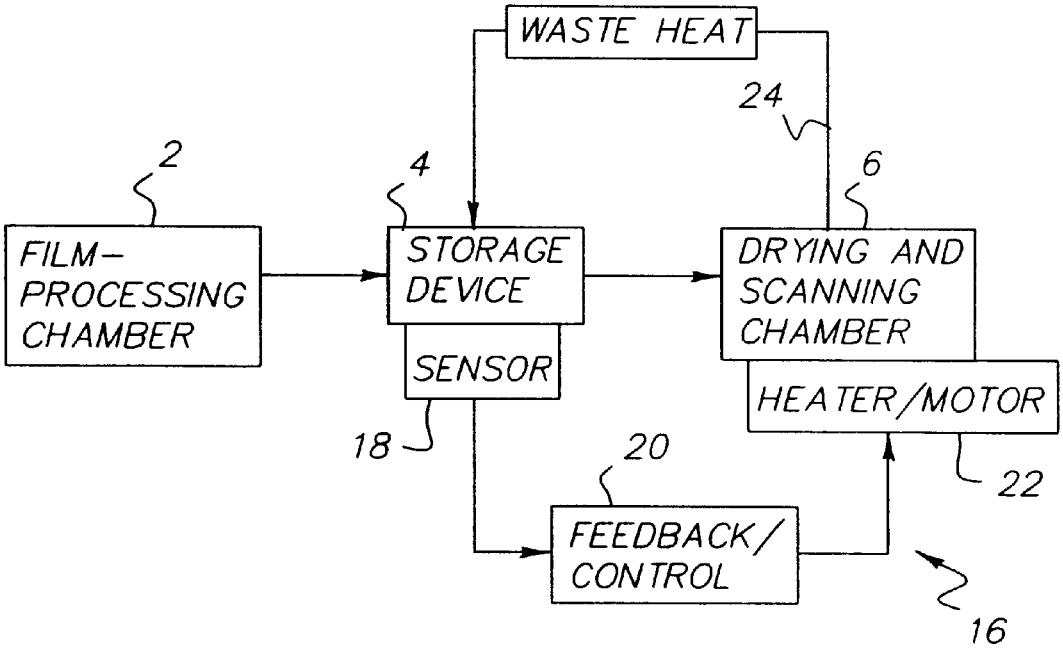
FIG. 4 shows a schematic block diagram of a further example of a photographic processing system according to the present invention.
Figure 3A:
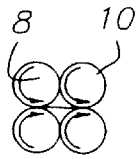
FIG. 3 shows a second example of a storage device suitable for use in the processing system of FIG. 1.

FIG. 4 shows a schematic block diagram of a further example of a photographic processing system according to the present invention. The processing system has the same components as in FIG. 1 described above but in this case is also provided with a drying control system 16. The drying control system has a sensor 18, such as a temperature and/or humidity sensor, in communication with the storage device 4. The sensor 18 must be capable of detecting a parameter of the film such that the drying can be controlled in dependence thereon. For example, the parameter may be the temperature or humidity of air in the storage device. A feedback control unit 20 is coupled between the sensor 18 and a heater/motor device 22 associated with the dryer 6. A waste heat coupler 24 is also provided to couple waste heat from the dryer to the storage device 4. The waste heat coupler may be a hot-air duct to channel exhaust air from the dryer to the storage device 6. Any other suitable form of heat coupler could be used so long as it is capable of transferring excess heat from the dryer 6 to the storage device 4. Exhaust or waste heat may also be transferred to the storage device form any other suitable source, such as a different part of the processing system.

In operation, the heater/motor device 22 is arranged to provide heat to the dryer 6 controlled in dependence on a signal received from the feedback control unit 20. As waste heat is coupled to the storage device 4 via the coupler 24, the temperature and the humidity of the storage device will rise and fall respectively. This means that an amount of drying of the film is actually performed in the storage device 4. This is detected by the sensor 18, which sends a corresponding signal to the feedback control unit 20 to adjust the heat provided to the dryer 6. Alternatively or in addition, the rate at which film passes through the drier may be controlled accordingly. For example, if it is detected that film in the storage device 4 is substantially dry, the rate at which the film passes through the dryer 6 can be increased. In other words, the greater the amount of drying performed in the storage device 4, the less required in the dryer 6 so that the temperature of the dryer can be reduced or the time it takes for a particular film to be dried can be correspondingly reduced. In both of these situations, an energy saving is made. In addition, since some drying is performed in the storage device 4, the path length though the dryer 6 can be reduced so that the dryer may be made smaller thereby reducing the footprint of the processing system.

The control provided by the feedback control unit 20 may be achieved using an associated microprocessor or a computer set up to run an appropriate control program. Alternatively a digital signal processor (DSP) may be used. In this case, the signal obtained from the sensor 18 is converted to a digital signal by an analogue-to-digital converter and the digital signal is then provided to the DSP. The DSP may then function to obtain a set point from a look up table and generate an appropriate output to the heater to control the temperature of the dryer. Use of a DSP enables accurate control of the dryer temperature to be achieved.

FIG. 5 shows an example of a storage device suitable for use in the processing system of FIG. 4. The storage device has essentially the same components as the one shown in FIGS. 2*a* to 2*d*. However, in this case the roller 12 from FIGS. 2*a* to 2*d* is replaced with a dryer 26. The dryer 26 is arranged to provide warm air received from the air duct 24 shown in FIG. 4. As with the roller 12 in FIGS. 2 and 3, as the dryer 26 is lowered, it is brought to bear on the film between the rollers 8 and 10 thereby increasing the path length of photographic material between them.

FIG. 6 shows an alternative arrangement for the storage device 4 for use in the processing system of the present invention. In this case two arrays 28 and 30 of rollers are provided to define a storage path of variable length for the photographic material 32 in the storage device. As mentioned above it is necessary for the two arrays to be moveable with respect to each other to enable the length of the storage path to be varied. It is possible that the array 28 is fixed and the array 30 is moved in a downward direction or that the array 30 is fixed and that the array 28 is moved in an upward direction. Again, any suitable item may be used to define the storage path for the photographic material such as, for example, air knives.

What is claimed is:

1. A photographic processing system, comprising:

a first processing stage to process photographic film;

a second processing stage comprising a scanner to scan the photographic film; and a storage device provided between the first processing stage and the second processing stage to receive and store photographic film output from the first processing stage prior to output to the second processing stage and perform a drying function, thereby to enable said photographic film to be output from the first processing stage at a different rate than that at which it is input to the second processing stage in which the scanner further comprises a dryer and in which a coupler is provided to couple exhaust heat from the dryer to the storage device to enable the storage device to perform the drying function.

2. A system according to claim 1, in which the system is a single chamber processing system in which the first processing stage comprises developing, fixing, bleaching and washing.

3. A system according to claim 1, in which the first processing stage comprises one or more of developing, fixing, bleaching, combined fixing/bleaching and washing.

4. A processing system according to claim 1, further comprising a sensor adapted to detect a parameter of the storage device and provide a corresponding signal to a controller to make a corresponding adjustment to the dryer.

5. A processing system according to claim 4, in which the parameter is the temperature of the storage device.

6. A processing system according to claim 4, in which the parameter is the humidity of the storage device.

7. A processing system according to claim 1, in which the storage device comprises a wet slack box having one or more path defining means to define a variable storage path for said photographic material that is output from the first processing stage prior to entry into the second processing stage.

8. A processing system according to claim 7, in which the path defining means are rollers.

9. A processing system according to claim 7, in which the path defining means are air knives.

10. A processing system according to claim 4, in which the controller is a microprocessor adapted to receive a signal from the sensor and provide a control signal to the heater of the dryer to adjust drying conditions accordingly.

11. A processing system according to claim 10, in which the microprocessor comprises a digital signal processor.

12. A method of photographic processing, using a photographic processing system comprising a first processing stage, a storage device arranged to receive processed film from said first processing stage and a second processing stage comprising a scanner and a dryer to receive film from said storage device, the method comprising the steps of:

processing a photographic film in the first processing stage of the photographic processing system;

providing said processed photographic film to the storage device;

providing film from said storage device to said second processing stage; and coupling exhaust heat from the dryer to the storage device to enable the storage device to perform a drying function.

13. A method of photographic processing comprising the steps of:

processing photographic material in a first processing stage;

storing the photographic material output from said first processing stage in a storage device, the storage device being adapted to receive and store a variable amount of said photographic material; and providing the stored photographic material to a second processing stage after a predetermined time interval, wherein the second processing stage includes a dryer and wherein exhaust heat from the dryer is coupled to the storage device to enable the storage device to perform a drying function.

14. A computer program comprising program code means for controlling the steps of a method of photographic processing, when said program is run on a computer, the method of photographic processing comprising the steps of:

processing photographic material in a first processing stage;

storing the photographic material output from said first processing stage in a storage device, the storage device being adapted to receive and store a variable amount of said photographic material; and providing the stored photographic material to a second processing stage after a predetermined time interval, wherein the second processing stage includes a dryer and wherein exhaust heat from the dryer is coupled to the storage device to enable the storage device to perform a drying function.

15. A photographic processing system, comprising:

a processing stage to process photographic material;

a drying stage to dry the photographic material after it has been processed by said processing stage;

a storage device provided between the processing stage and the drying stage to receive and store photographic material output from the processing stage to enable said photographic material to be output from the processing stage at a different rate than that at which it is input to the drying stage, wherein heat from the processing system is provided to the storage device to at least partly dry the photographic material therein; and a detector to detect a parameter related to the photographic material in the storage device and control the drying stage in dependence thereon.

16. A system according to claim 15, in which the heat provided from the processing system is exhaust heat from the drying stage.

* * * * *